US006667080B2

(12) United States Patent
Inamoto

(10) Patent No.: US 6,667,080 B2
(45) Date of Patent: Dec. 23, 2003

(54) RECORDING MEDIUM, PRODUCTION PROCESS AND HEAT-TREATMENT PROCESS OF THE RECORDING MEDIUM, AND RECORDING APPARATUS

(75) Inventor: Tadayoshi Inamoto, Tokyo (JP)

(73) Assignee: Canon Kabushiki Kaisha, Tokyo (JP)

( * ) Notice: Subject to any disclaimer, the term of this patent is extended or adjusted under 35 U.S.C. 154(b) by 298 days.

(21) Appl. No.: 09/774,627

(22) Filed: Feb. 1, 2001

(65) Prior Publication Data

US 2001/0030677 A1 Oct. 18, 2001

(30) Foreign Application Priority Data

Feb. 4, 2000 (JP) ..... 2000-027737
Dec. 26, 2000 (JP) ..... 2000-395410

(51) Int. Cl.[7] ..... B41M 5/00
(52) U.S. Cl. ..... 428/32.17; 428/32.25; 428/32.34
(58) Field of Search ..... 428/195, 323, 428/327, 304.4, 32.17, 32.25, 32.34

(56) References Cited

U.S. PATENT DOCUMENTS

| | | | | |
|---|---|---|---|---|
| 4,723,129 A | | 2/1988 | Endo et al. | 346/1.1 |
| 5,747,148 A | * | 5/1998 | Warner et al. | 428/212 |

FOREIGN PATENT DOCUMENTS

| | | | | |
|---|---|---|---|---|
| EP | 829375 | * | 10/1999 | B41M/5/00 |
| JP | 54-59936 | | 5/1979 | |
| JP | 64-43826 | | 2/1989 | |
| JP | 2-31673 | | 7/1990 | |
| JP | 2-276670 | | 11/1990 | |
| JP | 3-24906 | | 4/1991 | |
| WO | wo 98/52746 | * | 11/1998 | B32B/9/00 |
| WO | WO 99/55537 | * | 11/1999 | B41M/5/00 |

* cited by examiner

*Primary Examiner*—Bruce H. Hess
*Assistant Examiner*—B. Shewareged
(74) *Attorney, Agent, or Firm*—Fitzpatrick, Cella, Harper & Scinto

(57) ABSTRACT

Disclosed herein is a recording medium comprising a substrate and an ink-receiving layer provided on at least one side of the substrate. A surface of the recording medium on the side that the ink-receiving layer is provided has irregularities or steps.

3 Claims, 7 Drawing Sheets

RECORDING MEDIUM, PRODUCTION PROCESS AND HEAT-TREATMENT PROCESS OF THE RECORDING MEDIUM, AND RECORDING APPARATUS

BACKGROUND OF THE INVENTION

1. Field of the Invention

The present invention relates to a recording medium, a production process and a heat-treatment process of the recording medium, and a recording apparatus. In particular, the present invention relates to a card-like unforgeable recording medium suitable for use in a credit card, bank card, prepaid card, clinic card, membership card or the like.

2. Related Background Art

Various information have heretofore been stored in cards such as credit cards, bank cards, prepaid cards, clinic cards and membership cards. An exemplary production process of such a card is illustrated in FIG. 14 and FIG. 15.

Namely, an overlay sheet 103 is laid on top of a core sheet 101 subjected to printing such as screen printing or offset printing. A magnetic tape 104 is arranged at a proper position on the overlay sheet 103 if necessary (FIG. 14). These sheets are melted to laminate each other under heating and pressure to unite them (FIG. 15). At this time, the surface of the resulting card is smoothed by pressing a metal plate having a smooth surface against the surface of the card.

A card-sized piece is punched out of this laminate to produce a card. Base materials (101, 103) for the card include vinyl chloride resins, PETG resins, ABS resins and the like having good melt lamination properties.

Methods for applying information to such a card include magnetization, embossing, bar coding or the like. Further, so-called optical cards can be used in which, by means of a laser beam, a part of an optical recording layer on an information recording medium is volatilized out, the reflectance of the optical recording layer is changed, or the optical recording layer is deformed, whereby information is recorded and reproduced by a difference in optical reflectance or transmittance, and the like. In recent years, IC cards referred to as chip cards, memory cards, microcomputer cards or electronic cards, in which an IC chip is installed, have begun to be used.

In the above-described methods, however, it is not easy to identify information stored in such a card as the owner's own.

In general, uniform information such as logo prints, attention-requiring matters on use, agreements and an underground pattern or design are printed by the above-described screen printing or offset printing. However, such printing requires to make printing forms of the number of colors to be printed, and so it is difficult to make such forms for a short period of time, and a small quantity of production remarkably increases production cost.

In some cases, visible personal information, for example, a portrait and a name of an owner of a card, the available period of the subject matter of the card, etc., can be stored in the card. This can be achieved by adhering a photograph to the card or by printing with a sublimate-type thermal transfer printing system.

However, with the method in which the photograph itself is adhered to the card, it is difficult to make the card in a short period of time and at low cost.

The method using the sublimate type thermal transfer printing system has a drawback in that the cost of an ink ribbon used therefor is high, and so running cost becomes high. When full-color printing is conducted in particular, ink ribbons for 3 colors of yellow, magenta and cyan are always consumed irrespective of image density. Such a method is hence uneconomical. In addition, since such an ink ribbon is in the form of a thin film, it may have been broken upon its installation into a printer if an operator lacks experience. Further, there has been a limitation that a material suitable for the printing of the sublimate type thermal transfer printing system must be chosen for the surface of the card to be printed.

Since the printing is a contact type in which a printing head comes into contact with a printing surface of the card through an ink ribbon, in some cases, clean printing may not be obtained due to delicate irregularities on the printing surface, or printing failure may occur due to insufficient contact of the ink ribbon with the printing surface, if foreign matter such as dust is present on the surface of the card. In addition, there is a possibility that the printing head may come into contact with an end of the card when the printing is conducted up to the end of the card, and so the printing head may be damaged. Therefore, a blank is provided at the end of the card.

As a method for solving these problems, it has been proposed to provide an ink-receiving layer for ink jet on a surface of a card to conduct printing in accordance with an ink-jet recording method. According to this method, the above-described problem is avoided because this printing is a noncontact type in which a printing head does not come into contact with a printing surface.

There have heretofore been disclosed cards in which an ink-jet ink-receiving layer is laminated on a card substrate, and information is recorded on the ink-receiving layer by ink-jet recording. For example, Japanese Patent Application Laid-Open No. 64-43826 discloses a card in which an ink-receiving layer is laminated on a card substrate, and information is recorded on the ink-receiving layer by ink-jet recording.

Japanese Patent Publication No. 3-24906 discloses an ink-receiving layer comprising cationic aluminum oxide hydrate. Japanese Patent Application Laid-Open No. 2-276670 discloses an ink-receiving layer comprising alumina hydrate. Japanese Patent Publication No. 2-31673 describes a process for forming an ink-impermeable film on the printed surface of a recording medium after printing.

In recent years, forgery of information on a card for illegal use has become a social problem. The use of a card, in which a portrait of an owner of the card has been provided thereon, or personal information of the owner has been set forth thereon, should be useful for prevention of illegal uses. Even in such a card, however, additional information may be illegally recorded after regular recording. It is also difficult to identify the card as that having been issued from a regular origin of issue.

Additional recording may be conducted on the ink-receiving layer for ink-jet by ink-jet recording even after ink-jet recording is conducted. Further, additional printing may be conducted even in printing of the thermal transfer printing system. According to the method described in Japanese Patent Publication No. 2-31673, the ink-impermeable film is formed on the printed surface of the medium after ink-jet printing. Therefore, additional printing by ink-jet recording cannot be conducted. However, additional printing may be conducted by the thermal transfer printing system. Since no printing form is required for ink-jet recording, it is also easy to obtain a blank card to make a card in which forged information has been recorded. There is thus a demand for development of a measure to prevent such illegality.

SUMMARY OF THE INVENTION

It is an object of the present invention to provide an unforgeable recording medium, a production process and a heat-treatment process of the recording medium, and a recording apparatus.

The above object can be achieved by the present invention described below.

According to the present invention, there is provided a recording medium comprising a substrate and an ink-receiving layer provided on at least one side of the substrate, wherein a surface of the recording medium on the side that the ink-receiving layer is provided has irregularities or steps.

According to the present invention, there is also provided a process for producing a recording medium, which comprises laminating a plurality of substrate elements and heating the laminate under pressure, wherein a pressing member having irregularities or steps on a surface thereof is pressed against a surface of the laminate upon the heating.

According to the present invention, there is further provided a process for producing a recording medium, which comprises providing an uppermost layer of a thermoplastic resin on an ink-receiving layer and pressing a pressing means having irregularities or steps on a surface thereof under heating against the uppermost layer, thereby forming irregularities or steps on the uppermost layer.

According to the present invention, there is still further provided a process for heat-treating a recording medium having a substrate, an ink-receiving layer provided on at least one side of the substrate and an upper layer composed of thermoplastic resin particles capable of making the upper layer nonporous by heating and provided on the ink-receiving layer, comprising pressing a pressing means, the surface of which has partially nonuniform physical properties, against the upper layer, thereby making the upper layer nonporous and at the same time forming irregularities thereon.

According to the present invention, there is yet still further provided a recording apparatus comprising an ink-jet recording unit and a pressing means, the pressing means serving to heat-treat a recording medium by bringing the pressing means into contact under pressure with the surface of the recording medium after ink-jet recording and being equipped with a means for forming irregularities on the surface of the recording medium, and having a mechanism for aligning the recording medium toward a rotating and feeding direction of the pressing means, a mechanism for detecting the recording medium to be fed to the pressing means, a mechanism for detecting a rotational phase of the pressing means, and a mechanism for controlling the rotational phase of the pressing means or/and the position of the recording medium so as to form irregularities at the prescribed positions of the recording medium by analyzing a signal from the medium position detecting mechanism and a signal from the rotational phase detecting mechanism.

The irregularities or steps are scarcely observed in an ordinary state and do not affect the design of the resulting card. However, the irregularities or steps on the surface can be observed in relief by obliquely observing the card or irradiating the card with light to observe the reflected light. In addition, printing of the thermal transfer printing system cannot be beautifully conducted due to the irregularities or steps on the surface of the card, and so additional printing is substantially infeasible. Further, information can be given by varying irregularities or steps. For example, steps are provided so as to relieve the logo print of an issuer, thereby identifying the issuer, which is useful for prevention of forgery.

When printing of the thermal transfer printing system is conducted thereon, a transferred condition of a thermal transfer ink is changed at steps, and so the information printed is relieved to prove the additional printing. Therefore, the steps are useful for prevention of forgery.

DESCRIPTION OF THE PREFERRED EMBODIMENTS

Figure 1:
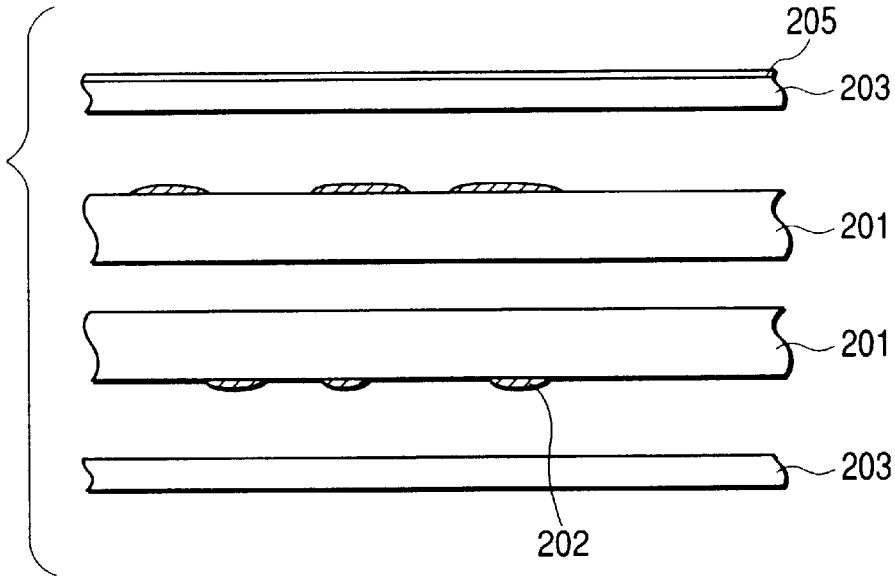
FIG. 1 illustrates respective substrate elements of a recording medium according to the present invention before melt laminating under heating.

The present invention provides recording media comprising a substrate and an ink-receiving layer for ink-jet recording provided on an least one side of the substrate, wherein a surface of the recording medium on the side that the ink-receiving layer is provided has irregularities or steps. The irregularities or steps preferably fall within the range of from 0.2 to 30 $\mu$m.

As the substrate used in the recording media according to the present invention, various kinds of material may be used as necessary for the end application intended. Examples of the materials usable as the substrate include resins, such as polyester resins such as polyethylene terephthalate, glycol-modified polyethylene terephthalate resins (PETG resins) represented by the following structural formula (I) and polybutylene terephthalate, polyvinyl chloride resins, polyvinylidene chloride resins, epoxy resins, polycarbonate resins, polyethylene resins, polypropylene resins, polystyrene resins, and ABS resins. In addition, paper and metals may also be suitable depending on uses.

(I)

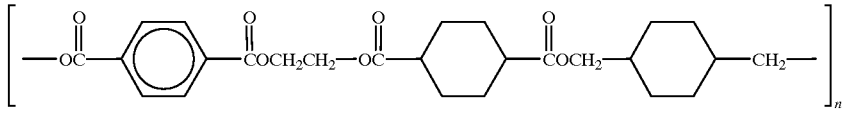

(n is a integer)

(I)

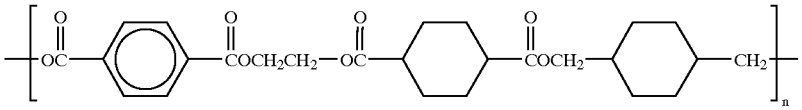

(n is a integer)

Uniformly determined information such as logo prints, attention-requiring matters on use and agreements may be printed in advance on one side or both sides of each of these substrates by screen printing, offset printing or the like.

The ink-receiving layer for ink-jet may be provided on only one side of the substrate to conduct ink-jet recording on said one side. Alternatively, the ink-receiving layer may be provided on both sides.

No particular limitation is imposed on the ink-receiving layer so far as it is generally used. A material having good ink-jet ink absorbency or a material containing an inorganic filler component or organic resin filler component hardened by a binder resin may also be used.

Examples of usable material having good ink absorbency include polyvinyl alcohol and modified products thereof, starch and modified products thereof, gelatin and modified products thereof, casein or modified products thereof, gum arabic, and cellulose derivatives such as carboxymethyl cellulose, hydroxyethyl cellulose and hydroxypropylmethyl cellulose.

With respect to the inorganic filler component or organic resin filler component, examples of usable inorganic filler include silica gel, alumina, titanium oxide, calcium silicate, synthetic zeolite and zinc oxide. Examples of usable organic resin fillers include polyvinyl chloride, polyvinyl acetate, polyacrylates, polystyrene and polyethylene. Examples of usable binder resins include polyvinyl alcohol and modified products thereof, starch and modified products thereof, gelatin and modified products thereof, casein or modified products thereof, gum arabic, cellulose derivatives such as carboxymethyl cellulose, hydroxyethyl cellulose and hydroxypropylmethyl cellulose, and polyvinyl pyrrolidone.

The content of the filler in the ink-receiving layer is preferably within the range of from 50 to 1,000 parts by mass per 100 parts by mass of the binder resin. Since an ink is absorbed in interstices of the filler, the ink absorbency of the ink-receiving layer is deteriorated if the amount of the filler is too small. If the amount of the filler is too large on the other hand, it is difficult to keep the bonding condition of the filler by the binder resin, and so the mechanical strength of the ink-receiving layer is lowered.

Pigment dispersants, viscosity modifiers, thickeners, anti-foaming agents, foam suppressors, fluorescent whitening agents, ultraviolet absorbents, antioxidants, mildewproofing agents, etc. may be suitably incorporated into the ink-receiving layer if necessary.

Upon the application of these materials to the substrate, the binder resin component is dissolved in a proper solvent, and the filler is finely dispersed in the resultant solution to prepare a coating formulation. The most preferable method includes one in which these materials are dissolved or dispersed in a solvent composed mainly of water to use the resultant solution or dispersion.

As a process for coating the ink-receiving layer on the substrate, there may be used a generally-used coating technique making use of a blade coater, air knife coater, roll coater, curtain coater, bar coater, sprayer or the like.

The coating amount of the ink-receiving layer is preferably within the range of from 3 to 80 g/m$^2$, more preferably 5 to 40 g/m$^2$ in terms of dry solids content. If the coating amount is too small, the ink absorbency of the resulting ink-receiving layer becomes insufficient even in the formation of images of a single color, and so good images may not be formed in some cases. In the formation of images of multi colors, the ink absorbency of the resulting ink-receiving layer may become insufficient when the coating amount is less than 5 g/m$^2$.

In ordinary ink-jet recording, ink absorbency is sufficient so far as an ink-receiving layer having a coating amount of about 40 g/m$^2$ in terms of dry solids content is formed. Even when an image having particularly high image density is printed, or an ink of a thin density is applied sufficiently for the purpose of giving gradation, the provision of an ink-receiving layer having a coating amount of about 80 g/m$^2$ suffices such purpose. If the coating amount of the ink-receiving layer is too large, a disadvantage is encountered from the viewpoint of cost.

After coating of the ink-receiving layer, the ink-receiving layer is dried by means of, for example, a hot-air drying oven or a heated drum. When the substrate is formed of a resin having a low softening point, such as a vinyl chloride resin, it is necessary at this time to control the drying temperature to a temperature at which the substrate is not deformed.

When the ink-receiving layer is formed of a material curable by heating, it is necessary to conduct a heat-treatment after the formation of the ink-receiving layer. When the substrate is formed of a resin having a low softening point, such as a vinyl chloride resin, it is effective to conduct the heat-treatment while pressing the recording medium by a pressing member so as not to deform the substrate. When the recording medium is pressed by, for example, a pressing member provided with irregularities or steps at its pressing surface at this time, irregularities or steps can be formed on the surface of the recording medium. More specifically, a pressing member on the surface of which irregularities have been formed by chemically etching or physically abrading the surface of glass, metal, stone, ceramic or the like can be utilized. In order to give specific information to the irregularities or steps, such irregularities or steps can be formed by subjecting a pressing member to a masking treatment upon processing of the pressing member. The thus-produced pressing member in the form of, for example, a plate is pressed against the ink-receiving layer under a pressure within the range of, for example, 0.01 to 1 MPa, thereby conducting the heat-treatment. The heating temperature is determined according to the thermal properties of the ink-receiving layer. When the substrate is formed by melt lamination of few or several substrate elements, the heating temperature may also be determined according to the thermal properties of the substrate elements. When the substrate is formed with a vinyl chloride resin, the heating temperature is generally preferably from 120 to 160° C. The heating temperature is preferably from 100 to 150° C. for PETG. After the heat-treatment, the recording medium is cooled to a temperature not higher than the heat distortion temperature of the substrate, and the pressure is then eliminated.

FIG. 1 illustrates respective substrate elements before melt lamination under heating. Printing is conducted on a core sheet 201 in advance and an ink-receiving layer 205 for ink-jet is provided on an overlay sheet 203 provided on one side of the core sheet 201. In the recording medium illustrated in FIG. 1, the substrate is formed by melt lamination of the core sheets 201 and overlay sheets 203, which are the substrate elements.

Figure 2:
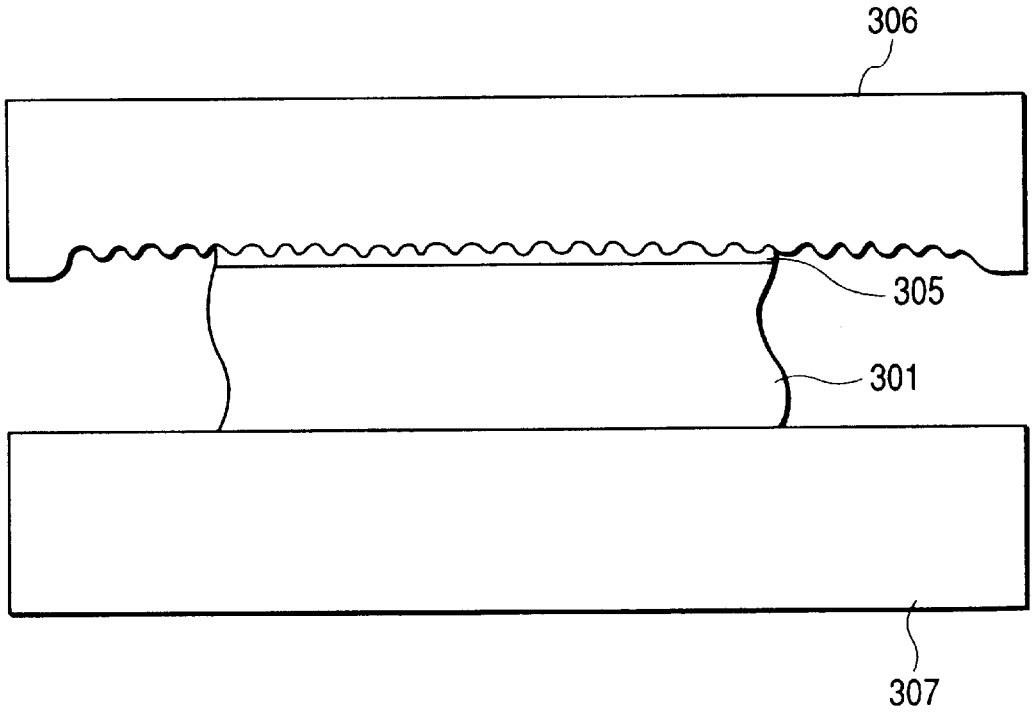
FIG. 2 illustrates a step of heating and pressing a recording medium by a pressing means having irregularities on its surface for the purpose of forming irregularities on the surface of an ink-receiving layer.

FIG. 2 illustrates a step of heating and pressing a recording medium by a pressing means 306 having irregularities on its surface and a pressing means 307 for the purpose of forming irregularities on the surface of an ink-receiving layer 305. Reference numeral 301 indicates a substrate.

A preferred embodiment of the recording medium according to the present invention is such that an uppermost layer formed of a porous layer comprising thermoplastic resin particles is provided on the ink-receiving layer described above, and the uppermost layer is melted by a heat-treatment after printing to make the uppermost layer nonporous, thereby shielding the ink-receiving layer from the air. The shelf stability of an image formed, such as light fastness and water fastness, is markedly improved by this embodiment, and at the same time, additional printing by ink-jet recording becomes infeasible.

The thermoplastic resin particles used in the uppermost layer may include, for example, particles of polyvinyl chloride, polyvinyl acetate, polyacrylate, polystyrene, polyethylene or the like. Particles of copolymers of monomers corresponding to these polymers may also be used.

The average particle diameter of the thermoplastic resin particles used in the uppermost layer is preferably within the range of from 0.1 to 5 $\mu$m, more preferably from 0.2 to 2 $\mu$m, most preferably from 0.2 to 0.8 $\mu$m.

If the average particle diameter of the thermoplastic resin particles is too small, the resin particles penetrate into interstices of the ink-receiving layer to clog the interstices of the ink-receiving layer with the resin particles, whereby the ink absorbency of the ink-receiving layer and the quality of an image formed thereon may be deteriorated in some cases. If the average particle diameter is too large, it is impossible to completely conduct the formation of the nonporous layer after printing, and so the shelf stability of the resulting recording medium may not be retained in some cases.

The porous layer comprising such thermoplastic resin particles is formed by applying a coating formulation containing the thermoplastic resin particles in a proportion of about 10 to 50% by mass in terms of solids content as the uppermost layer on the ink-receiving layer previously provided. For the coating amount of the thermoplastic resin particles, such a thickness that surface glossiness is imparted by the treatment after printing, development of interference light is prevented and a layer formed sufficiently functions as a protective layer is required. It is generally preferable to apply the coating formulation so as to give a thickness of 2 to 10 $\mu$m.

Figure 3:
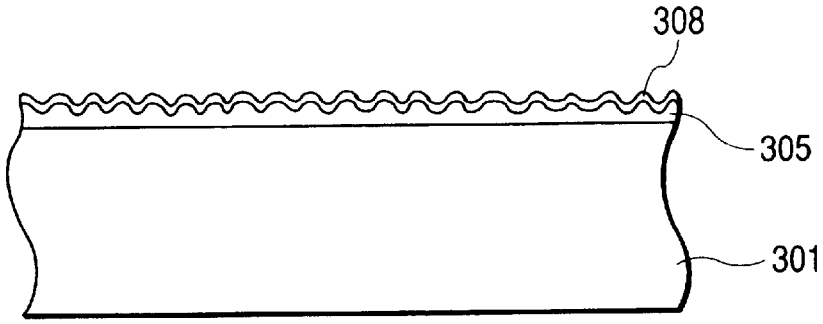
FIG. 3 illustrates a recording medium according to the present invention, in which an uppermost layer has been provided on an ink-receiving layer provided with irregularities.

A recording medium illustrated in FIG. 3 is a card, in which an uppermost layer 308 has been provided on an ink-receiving layer 305 provided with irregularities.

In the present invention, the formation of an image is then conducted by an ink-jet recording method. As inks used in the formation of the image, publicly known inks may be used without any problem. As coloring materials, direct dyes, acid dyes, basic dyes, reactive dyes and soluble dyes typified by food colors, disperse dyes and pigments may be used without any particular limitation. A pigment dispersion is preferably used when weathering resistance is regarded as important. These coloring materials are generally used in a proportion of 0.1 to 20% by mass in the conventional inks. Even in the present invention, they may be used in the same proportion as described above.

A solvent used in the inks used in the present invention is preferably water or a mixed solvent composed of water and at least one water-soluble organic solvent. Even non-aqueous solvents may be used without any problem. Taking safety, cost and the like into consideration in particular, a mixed solvent composed of water and a water-soluble organic solvent generally used in printers is preferred.

As an ink-jet recording method for conducting recording by applying the above-described inks to the recording medium according to the present invention, any system may be used so far as it is a system that an ink is effectively ejected out of a nozzle to apply it to the recording medium. In particular, an ink-jet recording system described in Japanese Patent Application Laid-Open No. 54-59936, in which an ink undergoes a rapid volumetric change by an action of thermal energy applied to the ink, so that the ink is ejected out of a nozzle by the working force generated by this change of state, may be used effectively.

Figure 4:
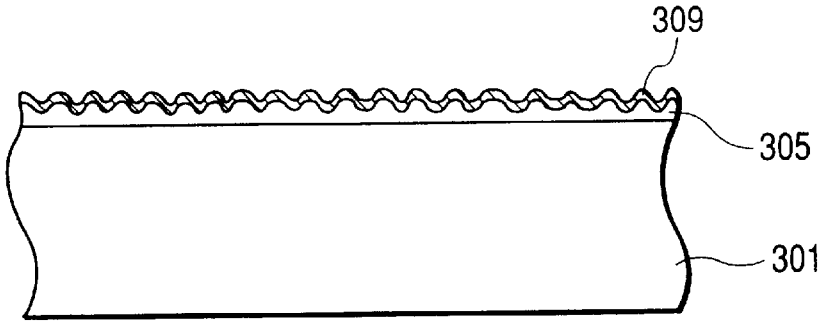
FIG. 4 illustrates a recording medium according to the present invention, in which the uppermost layer shown in FIG. 3 has been made nonporous.

In the case of the ink-receiving layer having the uppermost layer of the thermoplastic resin particles, the uppermost layer is heat-treated after printing, thereby making the uppermost layer formed of a porous layer nonporous. By conducting such a treatment, the weathering resistance of an image formed on the ink-receiving layer, such as light fastness and water fastness, is improved, glossiness can be imparted to the image, and the long-term storing of the resulting print becomes feasible. In addition, additional printing by ink-jet recording becomes infeasible. The heating temperature at this time is preferably within the range of from 90 to 180° C. considering influence on materials of the substrate, ink-receiving layer and inks, and surface properties after the formation of the nonporous layer, though the relationship with time must be considered as well. In the case where the substrate is formed of a material having a low softening point, such as a vinyl chloride resin, it is preferred that only the surface be irradiated with heat rays such as infrared rays in no contact with a heat source without heating the whole medium, thereby heating only the uppermost layer, or the heat-treatment be conducted in a short period of time by means of a heating laminator or the like. In the case where irregularities are provided on the surface of the ink-receiving layer, the underlying irregularities also manifest themselves on the uppermost layer by this heat-treatment, thereby forming irregularities on the surface of the resulting recording medium (FIG. 4).

Figure 5:
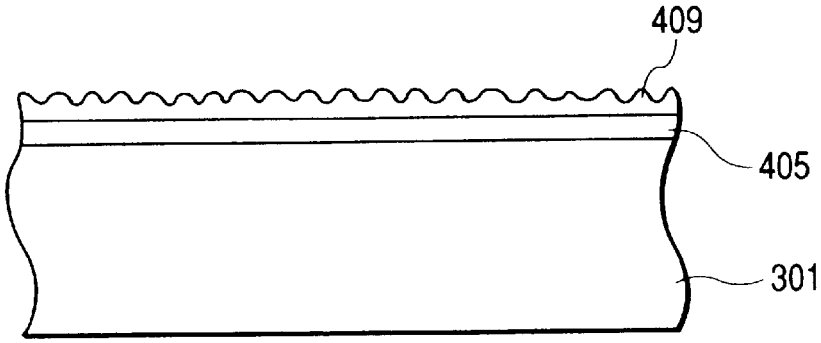
FIG. 5 illustrates a recording medium according to the present invention, in which an uppermost layer has been made nonporous by pressing a pressing means having irregularities on its surface against the uppermost layer.

According to another process of the present invention, as illustrated in FIG. 5, a pressing member having irregularities at its surface is pressed against an uppermost layer 409 under heating when the uppermost layer is made nonporous, whereby irregularities can be formed on the surface of the recording medium. In this process, there is no need to form irregularities on the surface of an ink-receiving layer 405.

As the pressing member, a roller having a built-in heater, on the surface of which irregularities have been formed, may be effectively used.

As a feature of the present invention, a member, the surface of which has partially nonuniform physical properties, is used as the pressing member without the need for a member with a surface having uniform physical properties.

Figure 6:
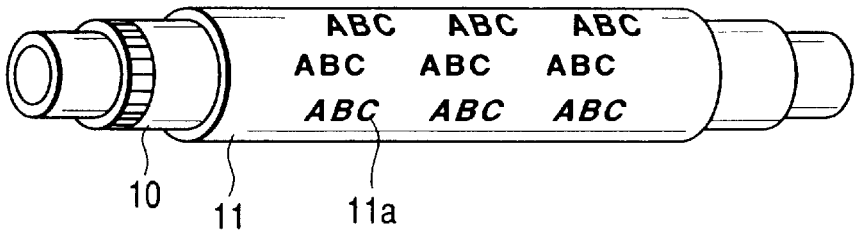
FIG. 6 is a perspective view illustrating an example of the press roller according to the present invention.
Figure 7:
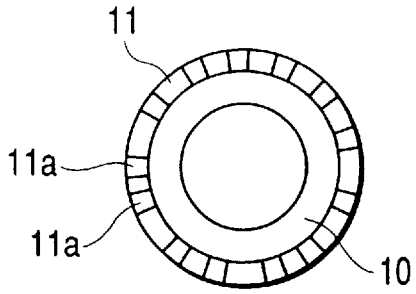
FIG. 7 is a cross-sectional view of the press roller illustrated in FIG. 6.

Examples of the pressing means, the surface of which has partially nonuniform physical properties, are illustrated in FIGS. 6 to 10. In FIGS. 6 and 7, rubber, the hardness of which regionally varies, is used as a rubber component on the surface of a roller which is the pressing means. Reference numeral 11 indicates the rubber on the surface of the pressing means. The portions 11*a* of characters are formed with rubber harder than other portions than the characters. The harder rubber formed in the form of characters in advance is stuck on a core 10, a layer of a rubber compound, by which the hardness of rubber after curing becomes softer than the rubber of the above-described character portions 11*a*, is then formed on the whole periphery of the core 10, and the surface of the rubber roller thus formed is then polished if necessary, whereby such a press roller as illustrated can be obtained.

Figure 8:
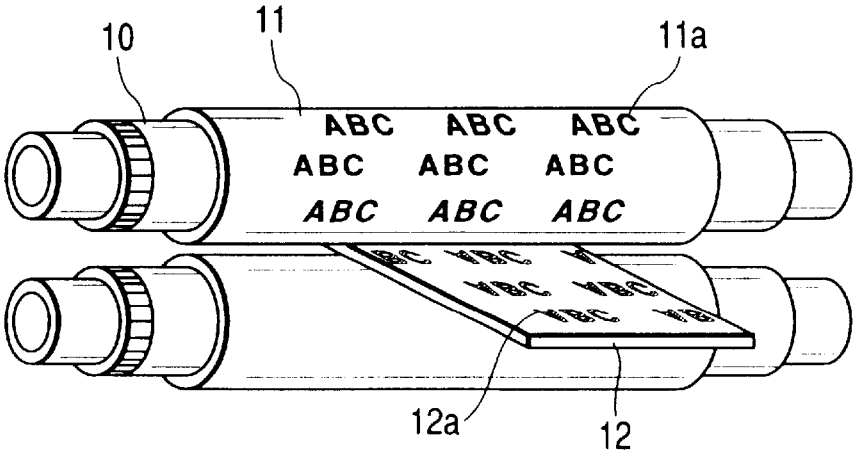
FIG. 8 is a perspective view illustrating a step of heat-treating a recording medium by the press roller illustrated in FIG. 6.

FIG. 8 typically illustrates a stage that a printed recording medium 12 has been heat-treated by using this press roller (portions printed by ink-jet recording are not illustrated).

Character portions 12*a* on the recording medium 12 indicate that the harder portions of the rubber roller have come into contact with the recording medium to form recessed portions in the recording medium, and so the information of the press roller has been transferred to the surface of the recording medium.

When a material having good thermal conductivity, for example, rubber in which fine powder of a metal or carbon black has been compounded, is used for rubber portions corresponding to the character portions 11*a*, a pressing means having good thermal conductivity at those portions alone can be produced. In the roller the thermal conductivity of which regionally varies, the surface temperature of the roller can be partially changed by cooling it right before the heat-treatment, and so irregularities can be formed on the surface of the recording medium in the same manner as described above.

All the embodiments described above are examples where rubber is used as a material. However, the material is not particularly limited to the rubber so far as the same effect is achieved.

Figure 9:
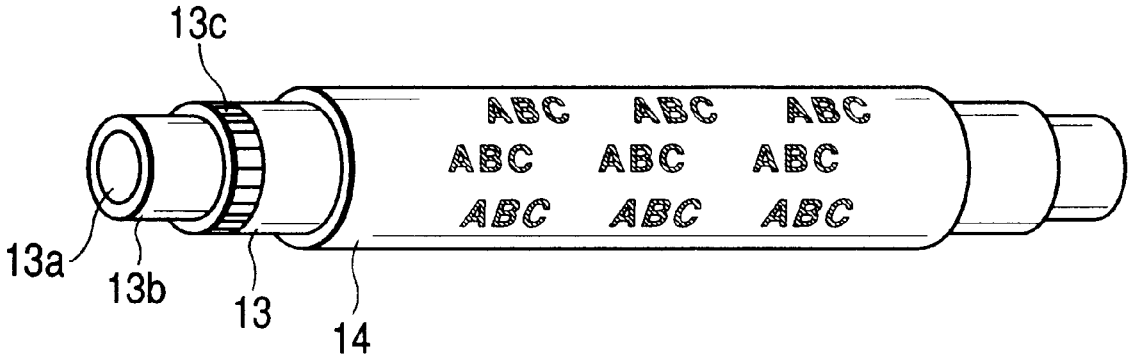
FIG. 9 is a perspective view illustrating another example of the press roller according to the present invention.
Figure 10:
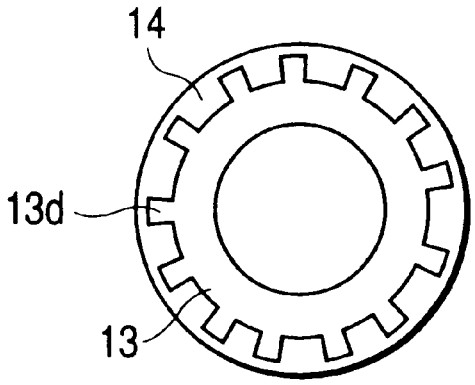
FIG. 10 is a cross-sectional view of the press roller illustrated in FIG. 9.

FIGS. 9 and 10 illustrate an example of a press roller in which the thickness of a core 13 is partially thickened corresponding to the form of desired information, whereby the thickness of rubber 14 on the surface of the roller is relatively thinned. In FIG. 9, a hollow part 13*a*, in which a heater is arranged, is provided in the center of the press roller. Since a halogen lamp is considered as a heat source in this case, the roller has been made hollow. However, the structure is not particularly limited to this structure when another heat source is used. Reference numerals 13*b* and 13*c* are portions of the core 13 and indicate a bearing and teeth for transmission of driving force, respectively. In FIG. 10, desired projected portions 13*d* are formed on the peripheral surface of the core 13, a cylindrical layer of rubber 14 is formed on the whole surface of the core 13, and the surface of the rubber roller thus formed is then polished if necessary, whereby such a press roller as illustrated can be obtained. The surface of the press roller illustrated in FIGS. 9 and 10 is formed of rubber as a whole. Since the thickness of the rubber at the thicker portions 13*d* of the core 13 is relatively thinner than other portions, the degree of deformation is smaller when pressing is conducted. On the contrary, the thickness of the rubber is greater at portions of the core 13, on which no projection has been provided, and the degree of deformation is greater when pressing is conducted. When the uppermost layer on the surface of the recording medium is heat-treated by means of this pressing member, irregularities are formed on the uppermost layer.

Figure 11:
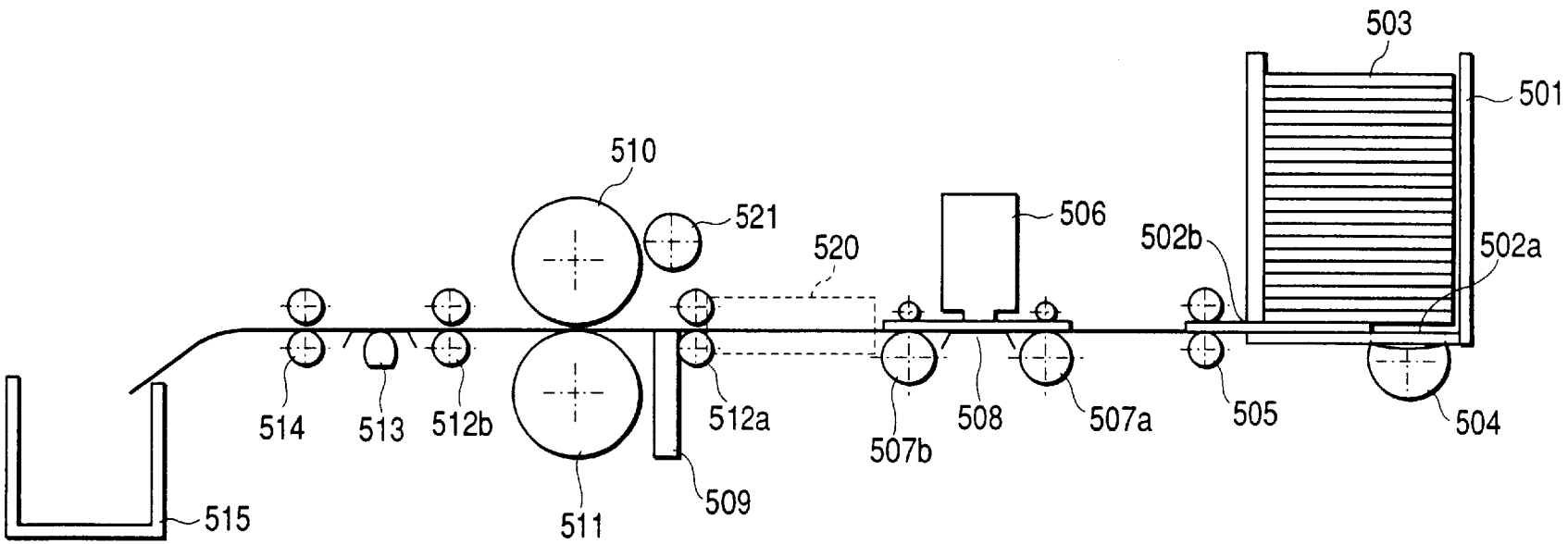
FIG. 11 illustrates an example of an ink-jet recording apparatus according to the present invention.

An example of a printing apparatus according to the present invention is illustrated in FIG. 11.

Reference numeral 501 indicates a card feeder for stacking cards 503, which are recording media, on one another and feeding them to a printing part. An opening 502*a* and a feed opening 502*b* are provided at a lower part of the card feeder. One of the stacked cards, which is at the lowest position, is discharged out of the feed opening 502*a* by rotating a pickup roller 504 on its axis, and fed to feed rollers 505. The feed rollers 505 feed the card to a feed roller 507 for printing. An ink-jet head 506 ejects an ink on a platen 508 while conducting a scanning motion in a direction substantially perpendicular to the feeding direction, and feed rollers 507*a* and 507*b* for printing feed the card corresponding to this scanning, thereby conducting printing.

Figure 12:
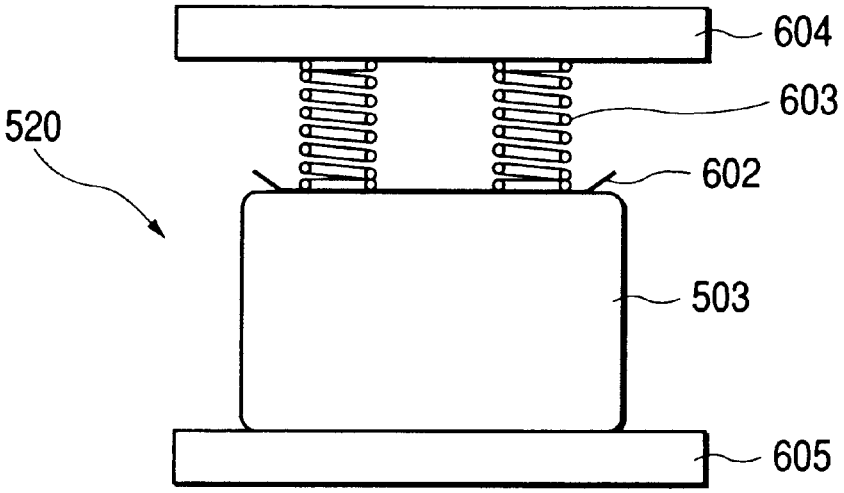
FIG. 12 illustrates an example of a side pressing mechanism used in the ink-jet recording apparatus shown in FIG. 11.

After completion of the printing, the direction of the card is aligned by an alignment mechanism 520, as shown in more detail in FIG. 12. The alignment is achieved by pressing one side of the card 503 against an end plate 605 by a side pressing plate 602 urged by springs 603. This mechanism may be provided before the printing part. The card is then fed to an edge-detecting sensor 509 by feed rollers 512*a*. The leading edge of the card is detected by the edge-detecting sensor, whereby the phase of a press roller 510 can be aligned with the position of the card to transfer the information of the press roller 510 to a prescribed position of the card. At the same time, a nonporous-layer-forming treatment for the uppermost layer of the card is also conducted. The card is then successively fed by feed rollers 512*b* and feed rollers 514. At this time, magnetic data is written in a magnetic stripe embedded in the card by a magnetic head 513 if necessary.

The card subjected to the ink-jet recording, heat-treatment and writing of the magnetic data is discharged to a stacker 515. In FIG. 11, reference numeral 521 indicates a cooling roller. In a press roller the thermal conductivity of which regionally varies, the cooling roller is brought into contact with the press roller right before the heat-treatment, whereby the surface temperature of the press roller can be partially changed. Therefore, the treatment conditions of the uppermost layer can be partially changed, whereby irregularities can be formed on the surface of the card.

Figure 13:
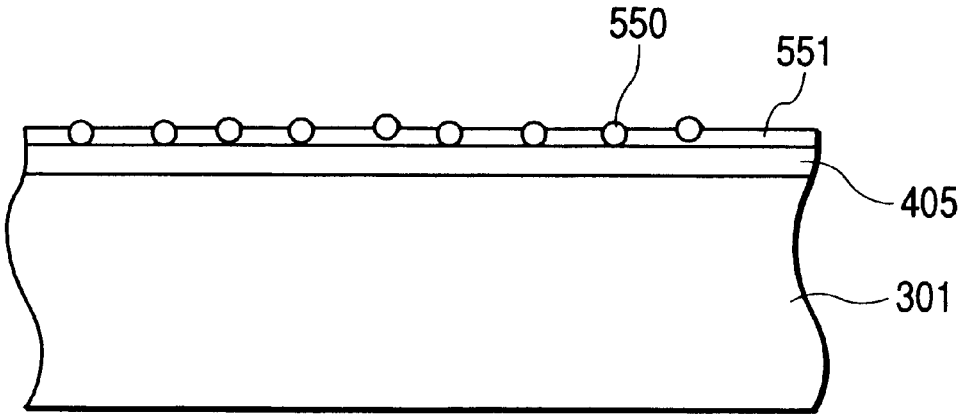
FIG. 13 illustrates a further example of the recording medium according to the present invention.
Figure 14:
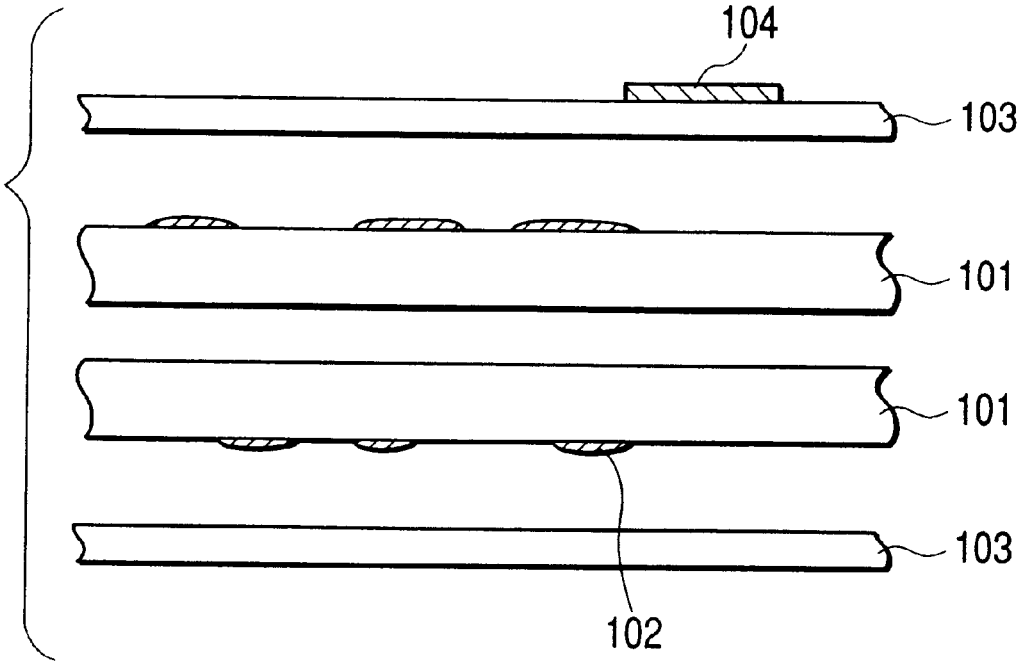
FIG. 14 illustrates respective substrate elements making up a conventional recording medium.
Figure 15:
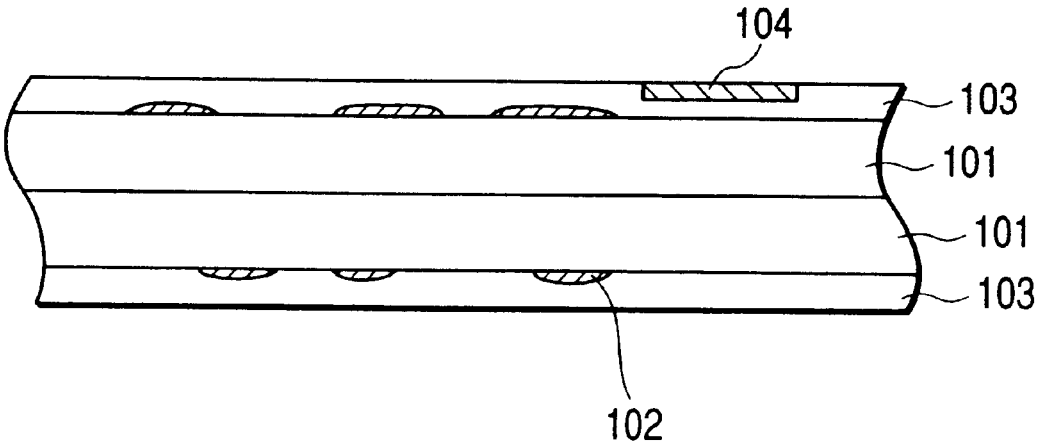
FIG. 15 illustrates the conventional recording medium obtained by melt lamination of the respective substrate elements.

As illustrated in FIG. 13, large particles 550 may be contained in an uppermost layer 551 so as to form irregularities on the uppermost layer. The large particles 550 contained in the uppermost layer 551 retain their original sizes even after the nonporous-layer-forming treatment. Therefore, they are preferably transparent and have a particle diameter of 2 to 50 $\mu$m. If the particle diameter is too small, sufficient irregularities cannot be formed. If the particle diameter is too large, the particles may be released from the uppermost layer in some cases. As the large particles, silica or silicone may be used, for example.

The present invention will hereinafter be described in more detail by the following Examples. However, the present invention is not limited to these examples.

EXAMPLE 1

A coating formulation for an ink-receiving layer was first prepared in the following manner. Alumina hydrate (sol) having a structure in the form of a hair bundle (ciliary form) was synthesized as an inorganic filler by a hydrolyzing and deflocculating process of aluminum isopropoxide. To 100 parts by mass, in terms of solids content, of the alumina hydrate, were added 10 parts by mass of polyvinyl alcohol (trade name: PVA117, product of Kuraray Co., Ltd.), 0.5 parts by mass of boric acid ($H_3BO_3$) and water, thereby preparing the coating formulation using water as a medium. This coating formulation was coated on a white hard vinyl chloride resin plate having dimensions of 300 mm×200 mm and a thickness of 0.74 mm and dried at 60° C. for 20 minutes. The thickness of an ink-receiving layer formed was 40 $\mu$m in a dried state.

The surface of an SUS304 plate having dimensions of 400 mm×300 mm and a thickness of 1 mm was etched for 5 minutes with an aqueous solution of ferric chloride having a Baume degree of 42. Irregularities formed on the surface were 8 $\mu$m.

This plate was pressed against the vinyl chloride resin plate coated with the previously prepared coating formulation for ink-receiving layer to treat the resin plate at 150° C. while applying a pressure of 0.5 MPa. The resin plate was then allowed to cool to 40° C. over 1 hour.

Vinyl chloride resin particles (trade name: G-351, product of Nippon Zeon Co., Ltd.; vinyl chloride latex, film-forming temperature: 100 to 110° C.) of thermoplastic resin particles were applied as an uppermost layer on the ink-receiving layer by means of a wire bar so as to give a dry thickness of about 5 $\mu$m, and dried at 50° C. for 15 minutes. Thereafter, a card-sized piece of 85.6 mm×54.0 mm having a roundness of 3.0 mm at 4 corners was punched out of this recording medium.

A BJ printer (ink-jet printer), BJC-700J (trade name, manufactured by Canon Inc.) was used to conduct ink-jet printing on the card thus obtained. BC-60 and BC-62 (trade names, products of Canon Inc.) were used as ink cartridges. The printing was conducted in accordance with a mode of hand feed by sticking a cardboard on the back side of the card.

After the printing, the card was passed though heated rubber rollers by means of a laminator to make the uppermost layer nonporous. The treatment was conducted at a roller temperature of 150° C. and a feed speed of 60 mm/sec. A change was scarcely observed on the card-like medium, and the latex layer of the uppermost layer could be made nonporous. Irregularities of about 5 $\mu$m were formed on the surface thereof. The ink-jet print was clear and beautiful. Additional printing by ink-jet recording was infeasible because the surface of the card was lacking of ink absorbency. When thermal transfer printing was conducted thereon, only a blurred print was obtained due to the irregularities formed on the surface.

EXAMPLE 2

An experiment was conducted in the same manner as in EXAMPLE 1 except that the material of the substrate was changed to PETG. As a result, the resultant card was such that additional printing by ink-jet recording was infeasible, and only a blurred print was obtained in additional printing by thermal transfer printing like EXAMPLE 1.

EXAMPLE 3

An experiment was conducted in the same manner as in EXAMPLE 1 until the ink-receiving layer was coated on the vinyl chloride resin plate. In a heat-treatment subsequently conducted, an SUS304 plate having a smooth surface was pressed against the vinyl chloride resin plate to conduct the heat-treatment. The surface of the ink-receiving layer thus obtained was smooth. An uppermost layer was provided thereon in the same manner as in EXAMPLE 1. Thereafter, a card-sized piece of 85.6 mm×54.0 mm having a roundness of 3.0 mm at 4 corners was punched out of this recording medium. Ink-jet printing was conducted on this card in the same manner as in EXAMPLE 1.

After the printing, the card was heated by means of a laminator in the same manner as in EXAMPLE 1 to make the uppermost layer nonporous. In this step, however, SUS304 rollers were used in place of the rubber rollers. The surface of the SUS304 roller was etched with an aqueous solution of ferric chloride like the SUS plate used in the heat-treatment of the ink-receiving layer. The thus-obtained heated roller, on the surface of which irregularities of about 8 $\mu$m had been formed, was used. By this treatment, the surface of the card was made nonporous, and the surface profile of the heated roller was transferred to the surface, thereby forming irregularities of about 8 $\mu$m.

The ink-jet print on the thus-obtained card was clear and beautiful. Additional printing by ink-jet recording was infeasible because the surface of the card was lacking of ink absorbency. When thermal transfer printing was conducted thereon, only a blurred print was obtained due to the irregularities formed on the surface.

EXAMPLE 4

An experiment was conducted in the same manner as in EXAMPLE 3 except that the material of the substrate was changed to PETG. As a result, the resultant card was such that additional printing by ink-jet recording was infeasible, and only a blurred print was obtained in additional printing by thermal transfer printing like EXAMPLE 3.

EXAMPLE 5

An experiment was conducted in the same manner as in EXAMPLE 3 until the uppermost layer was formed. A liquid with silica particles having an average particle diameter of 10 $\mu$m contained in the same vinyl chloride latex as that used in EXAMPLE 1 was coated as an uppermost layer thereon. The vinyl chloride latex and the silica particles were mixed so as to give a mass ratio of the vinyl chloride latex to the silica particles of 100:1. Thereafter, ink-jet printing was conducted in the same manner as in EXAMPLE 1, and the uppermost layer was made nonporous by means of the heated rollers in the same manner as in EXAMPLE 1. As a result, the resultant card was such that additional printing by ink-jet recording was infeasible, and only a blurred print was obtained in additional printing by thermal transfer printing like EXAMPLE 3.

EXAMPLE 6

An experiment was conducted in the same manner as in EXAMPLE 5 except that a white ABS resin plate having a thickness of 0.70 mm was used as a substrate. Further, ink-jet printing, and the formation of a nonporous uppermost layer were conducted to produce a printed card-like medium. As a result, a card incapable of conducting additional printing was obtained like EXAMPLE 5.

EXAMPLE 7

An ink-receiving layer was coated on a vinyl chloride resin plate in the same manner as in EXAMPLE 3, and an SUS304 plate having a smooth surface was pressed against the vinyl chloride resin plate to conduct a heat-treatment. The surface of the ink-receiving layer thus obtained was smooth. An uppermost layer was provided thereon in the same manner as in EXAMPLE 3. Thereafter, a card-sized piece of 85.6 mm×54.0 mm having a roundness of 3.0 mm at 4 corners was punched out of this recording medium. Ink-jet printing was conducted on this card in the same manner as in EXAMPLE 1.

After the printing, the card was heated by means of a laminator in the same manner as in EXAMPLE 1 to make the uppermost layer nonporous. In this step, however, a roller, on the surface of which irregularities had been formed in the following manner, was used as the press roller.

Namely, a repeated pattern of circles with 2 mm in diameter at a pitch of 4 mm was formed as a masking for etching on the surface of an SUS roller by photolithography. This roller was etched for 3 minutes with an aqueous solution of ferric chloride in the same manner as in EXAMPLE 3. The degree of etching was about 6 $\mu$m. The resist was then separated, and the whole roller was treated for 30 seconds with the etchant. Recesses of about 6 $\mu$m in the form of circles with 2 mm in diameter at a pitch of 4 mm were formed in the surface of the roller. The card was made nonporous by means of this roller. The surface of the thus-treated card was satin-finished as a whole, and the circles formed in the surface could not be easily observed at a glance. However, when the surface was obliquely observed, or the surface was laterally irradiated with light to observe a reflected shadow, the circular pattern could be clearly observed to identify a difference from the card produced in EXAMPLE 3. Additional printing by ink-jet recording was infeasible. When additional printing was conducted thereon by the thermal transfer printing system, only a blurred print was obtained, and moreover the circular pattern was relieved, whereby the additional printing was clearly distinguished.

EXAMPLE 8

A coating formulation for an ink-receiving layer was first prepared in the following manner. Alumina hydrate (sol) having a structure in the form of a hair bundle (ciliary form) was synthesized as an inorganic filler by a hydrolyzing and deflocculating process of aluminum isopropoxide. To 100 parts by mass, in terms of solids content, of the alumina hydrate, were added 10 parts by mass of polyvinyl alcohol (trade name: PVA117, product of Kuraray Co., Ltd.), 0.5 parts by mass of boric acid ($H_3BO_3$) and water, thereby preparing the coating formulation using water as a medium.

This coating formulation was coated on a white hard vinyl chloride resin plate having dimensions of 300 mm×200 mm and a thickness of 0.74 mm and dried at 60° C. for 20 minutes. The thickness of an ink-receiving layer formed was 40 $\mu$m in a dried state.

An SUS304 plate having dimensions of 400 mm×300 mm and a thickness of 1 mm and having a smooth surface was pressed against the vinyl chloride resin plate coated with the previously prepared coating formulation for ink-receiving layer to treat the resin plate at 160° C. while applying a pressure of 6 kg/cm$^2$. The resin plate was then allowed to cool to 40° C. over 1 hour. Vinyl chloride resin particles (trade name: G-351, product of Nippon Zeon Co., Ltd.; vinyl chloride latex, film-forming temperature: 100 to 110° C.) of thermoplastic resin particles were applied as an uppermost layer on the ink-receiving layer by means of a wire bar so as to give a dry thickness of about 5 $\mu$m, and dried at 60° C. for 15 minutes. Thereafter, a card-sized piece of 80.6 mm×64.0 mm having a roundness of 3.0 mm at 4 corners was punched out of this recording medium.

A BJ printer (ink-jet printer), BJF-850 (trade name, manufactured by Canon Inc.) was used to conduct ink-jet printing on the card thus obtained. BC-60 and BC-62 (trade names, products of Canon Inc.) were used as ink cartridges. The printing was conducted in accordance with a mode of hand feed by sticking a cardboard on the back side of the card.

After the printing, with respect to the card thus obtained, the uppermost layer was heat-treated by means of the press roller illustrated in FIG. 6 to make it nonporous. The surface temperature of the press roller was 160° C., and the feed speed thereof was 40 mm/sec. The latex layer of the uppermost layer was made nonporous, and irregularities of about 4 $\mu$m were formed on the surface thereof. The irregularities were able to be observed by obliquely irradiating the card with light, and the characters could be clearly observed. The ink-jet print was clear and beautiful. Additional printing by ink-jet recording was infeasible because the surface of the card was lacking of ink absorbency. When thermal transfer printing was conducted thereon, only a blurred print was obtained due to the irregularities formed on the surface.

EXAMPLE 9

An experiment was conducted in the same manner as in EXAMPLE 8 except that the material of the substrate was changed to PETG. As a result, the irregularities were able to be observed by obliquely irradiating the card with light, and the characters could be clearly observed. The resultant card was such that additional printing by ink-jet recording was infeasible, and only a blurred print was obtained in additional printing by thermal transfer printing like EXAMPLE 8.

EXAMPLE 10

The same recording medium as that used in EXAMPLE 8 was used as a recording medium after printing. As the press roller, a roller with characters embossed on the core as illustrated in FIG. 9, the rubber thickness corresponding to the characters being thin, was used. A heat-treatment was conducted in the same manner as in EXAMPLE 8 except that this press roller was used. As a result, the irregularities were able to be observed by obliquely irradiating the card with light, and the characters could be clearly observed. The resultant card was such that additional printing by ink-jet recording was infeasible, and only a blurred print was obtained in additional printing by thermal transfer printing like EXAMPLE 8.

EXAMPLE 11

An experiment was conducted in the same manner as in EXAMPLE 10 except that the material of the substrate was changed to PETG. As a result, the resultant card was such that additional printing by ink-jet recording was infeasible, and only a blurred print was obtained in additional printing by thermal transfer printing like EXAMPLE 10.

EXAMPLE 12

Rubber containing 40% by weight of fine powder of ferric oxide was used at portions corresponding to characters to make a press roller similar to that used in EXAMPLE 8. This press roller was used to heat-treat a card medium subjected to ink-jet recording. However, the surface temperature of the press roller was controlled in advance to 170° C., and then the surface of the press roller was rapidly cooled down by bringing a metallic roller at room temperature into contact with the press roller right before the treatment. The surface temperature of the rubber corresponding to the portions containing ferric oxide was more lowered than the other surface of the roller, whereby the temperature conditions could be locally changed, and so corresponding irregularities were formed on the surface of the card. The characters could be clearly observed.

According to the present invention, as described above, cards substantially incapable of receiving additional printing can be provided. In addition, cards capable of identifying an origin of issue can be obtained even when they are blank cards. Accordingly, recording media very effective for prevention of forgery can be provided with ease. Further, card-like recording media on which personal information has been beautifully printed by ink-jet recording can be provided with ease.

What is claimed is:

1. A recording medium, comprising a substrate, a recorded layer with ink-jet recorded information and a non-porous layer on the substrate recorded layer, wherein the non-porous layer has an outer surface with irregularities or steps, the non-porous layer being formed by nonporous-layer forming treatment of a porous layer formed on the surface of the substrate, wherein the outer surface has visible information comprised of a pattern of the irregularities or steps, and wherein the non-porous layer prevents additional ink-jet recording on the outer surface thereof.

2. The recording medium according to claim 1, wherein the irregularities or steps have dimensions within a range of from 0.2 to 30 $\mu$m.

3. The recording medium according to claim 1, wherein the ink-jet recorded information includes characters and images printed by an ink-jet recording method.

* * * * *

UNITED STATES PATENT AND TRADEMARK OFFICE

CERTIFICATE OF CORRECTION

PATENT NO. : 6,667,080 B2 
DATED : December 23, 2003
INVENTOR(S) : Inamoto

It is certified that error appears in the above-identified patent and that said Letters Patent is hereby corrected as shown below:

Title page,
Item [56], References Cited, FOREIGN PATENT DOCUMENTS, "wo 98/52746" should read -- WO 98/52746 --.

Column 1,
Line 16, "have" should read -- has --.
Line 49, "an under-" should read -- a back- --.

Column 5,
Lines 15-20, "

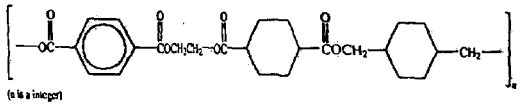

"

Column 6,
Line 55, "such" should read -- for such a --.

Column 8,
Line 47, "far" should read -- long --.

Column 9,
Line 44, "that" should read -- in which --.

Column 11,
Line 9, "Therefore, they" should read -- They --.

UNITED STATES PATENT AND TRADEMARK OFFICE

CERTIFICATE OF CORRECTION

PATENT NO. : 6,667,080 B2
DATED : December 23, 2003
INVENTOR(S) : Inamoto

It is certified that error appears in the above-identified patent and that said Letters Patent is hereby corrected as shown below:

Column 16,
Line 13, "substrate" should be deleted.

Signed and Sealed this

Twenty-fourth Day of August, 2004

JON W. DUDAS
*Director of the United States Patent and Trademark Office*